US006321995B1

(12) United States Patent
Badovick et al.

(10) Patent No.: US 6,321,995 B1
(45) Date of Patent: Nov. 27, 2001

(54) THERMOSTATIC EXPANSION VALVE

(75) Inventors: Jeffrey P. Badovick, Ormond Beach; Jasper M. Hendrick, Jr., Daytona Beach; Jeffrey V. Christiano, Ormond Beach; Todd A. Krawczyk, Oviedo; Russell E. Smith, Lake Mary, all of FL (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 09/670,683

(22) Filed: Sep. 27, 2000

Related U.S. Application Data

(60) Provisional application No. 60/160,663, filed on Oct. 21, 1999.

(51) Int. Cl.[7] ..... F25B 41/04

(52) U.S. Cl. ..... 236/92 B; 62/225; 251/323

(58) Field of Search ..... 62/225; 236/92 B; 251/321, 323

(56) References Cited

U.S. PATENT DOCUMENTS

| | | | | |
|---|---|---|---|---|
| 3,163,225 | * | 12/1964 | Perkins | 251/321 |
| 3,402,566 | * | 9/1968 | Leimbach | 62/225 |
| 3,537,645 | | 11/1970 | Treder | 236/92 B |
| 3,667,247 | | 6/1972 | Proctor | 62/217 |
| 3,756,273 | | 9/1973 | Hengesbach | 137/540 |
| 3,810,366 | | 5/1974 | Orth | 62/217 |
| 3,817,053 | | 6/1974 | Orth | 62/210 |
| 3,822,563 | | 7/1974 | Orth | 62/217 |
| 3,842,616 | * | 10/1974 | Orbesen | 62/225 |
| 3,945,396 | | 3/1976 | Hengesbach | 137/496 |
| 4,271,864 | | 6/1981 | Neff | 137/599 |
| 4,462,421 | | 7/1984 | Ross et al. | 137/542 |
| 4,542,852 | | 9/1985 | Orth et al. | 236/92 B |
| 5,269,459 | | 12/1993 | Thompson et al. | 236/92 B |
| 5,423,480 | * | 6/1995 | Heffner et al. | 62/225 |

* cited by examiner

*Primary Examiner*—William E. Tapolcal
(74) *Attorney, Agent, or Firm*—Christopher H. Hunter

(57) ABSTRACT

A thermostatic expansion valve for a vehicle air-conditioning system includes a valve body with a condenser passage and an evaporator passage, and a power element supported on one end of the body. The power element includes a diaphragm and a pressure pad disposed against the lower surface of the diaphragm. The pressure pad includes a valve stem engaging a valve assembly in the valve body to control the flow of refrigerant between the condenser and evaporator. The valve assembly includes i) a plunger retainer threadably received in the condenser passage, ii) a plunger moveably connected to the plunger retainer and having a throttling member controlling the flow through an orifice in the metering passage, and iii) a spring extending between the plunger retainer and the plunger and biasing the plunger, and hence the throttling member, toward the orifice. The plunger includes a stem with an annular catch at the distal end; while the plunger retainer includes a pair of fingers with catch devices at their distal ends. The catch device of the stem and the catch devices of the plunger retainer prevent the plunger, plunger retainer and spring from being easily disassembled. A valve stem extends downwardly from the diaphragm through an internal bore in the valve body into the metering passage and engages the valve assembly. The movement of the diaphragm in the diaphragm chamber controls the movement of the throttling member of the valve assembly and hence controls the flow through the expansion valve.

39 Claims, 3 Drawing Sheets

THERMOSTATIC EXPANSION VALVE

CROSS-REFERENCE TO RELATED CASES

The present application claims priority to U.S. Provisional Application Ser. No. 60/160,663; filed Oct. 21, 1999.

FIELD OF THE INVENTION

The present invention relates generally to thermostatic expansion valves for air-conditioning systems, and more particularly to thermostatic expansion valves for vehicle air-conditioning systems.

BACKGROUND OF THE INVENTION

In a typical vehicle air-conditioning system, refrigerant is compressed by a compressor unit driven by the automobile engine. The compressed refrigerant, at high temperature and pressure, enters a condenser where heat is removed from the compressed refrigerant. The refrigerant then travels through a receiver/dryer to an expansion valve. The expansion valve throttles the refrigerant as it flows through a valve orifice, which causes the refrigerant to change phase from liquid to a saturated liquid/vapor mixtures as it enters the evaporator. In the evaporator, heat is drawn from the environment to replace the latent heat of vaporization of the refrigerant, thus cooling the environmental air. The low pressure refrigerant flow from the evaporator returns to the suction side of the compressor to begin the cycle anew.

The high pressure refrigerant flow through the expansion valve must be regulated in response to the degree of superheat of the refrigerant flow between the evaporator and suction side of the compressor to maximize the performance of the air-conditioning system. The superheat is defined as the temperature difference between the actual temperature of the low pressure refrigerant flow and the temperature of evaporation of the flow.

Thermostatic expansion valves typically include a power element comprising a diaphragm mounted between a domed head and a support cup on the valve body. A "charge" is located within a head chamber defined by the domed head and one (upper) surface of the diaphragm. The support cup and the other (lower) surface of the diaphragm define a diaphragm chamber with the body of the expansion valve. A valve stem extends downwardly from the diaphragm through a bore in the valve body to a valve element modulating a valve orifice between a first port in the valve body (to the condenser) and a second port in the valve body (to the evaporator). Proctor, U.S. Pat. No. 3,667,247; Treder; U.S. Pat. No. 3,537,645; and Orth, U.S. Pat. No. 4,542,852, for example, show such expansion valves.

To control the refrigerant flow, the diaphragm in the power element moves in response to the refrigerant condition exiting the evaporator and compensates the flow rate to the evaporator by opening or closing the valve orifice. One type of device used to communicate the refrigerant condition to the diaphragm is a feeler bulb. The feeler bulb is positioned in contact with the pipe carrying the refrigerant, and a tube extends from the feeler bulb to the diaphragm chamber such that the refrigerant charge in the diaphragm chamber is at essentially the temperature of the refrigerant at the location of the bulb. Refrigerant pressure against the bottom of the diaphragm along with the force of an adjustment spring on the valve element tends to close the valve, while pressure from the charge tends to open the valve.

Another, more recent device to sense the degree of flow superheat is the block-type ("bulbless") thermostatic expansion valve. In certain bulbless valves, a thermally conductive pressure pad is located against the lower surface of the diaphragm. As the refrigerant passes around the pressure pad, heat energy is transferred by conduction through the pad to the refrigerant charge in the head chamber above the diaphragm valve. A portion of the diaphragm surrounding the pressure pad is typically also exposed and in direct contact with the refrigerant. The balance of forces across the diaphragm along with the spring constant of the diaphragm determine the deflection of the diaphragm and hence the opening of the expansion valve orifice between the condenser and evaporator. The diaphragm deflects as appropriate to maintain a balance between these forces.

A typical valve element for a thermostatic expansion valve includes a ball located in a ball retainer or ball seat which is biased by a spring against the valve orifice between the condenser port and the evaporator port. It is also known to support the ball directly against the end coil of the spring, and to use a cone-shaped element instead of a ball. In any case, the valve steam engages the ball and urges the ball away from the orifice in response to movement of the diaphragm. The spring is held in place by a gland or spring seat, which can be screwed into the passage leading to the outlet in the body. Adjustment of the axial location of the gland (such as by screwing the gland into or out of the valve body) adjusts the spring force on the valve ball, and hence adjusts the flow through the valve. The ball retainer and gland are typically formed from brass, and are otherwise separated from each other by the spring.

While the valve element described above performs satisfactorily for many applications, the various components of the element can be difficult to assemble and can fall apart and become lost when the element is removed, such as for inspection and repair. The components are also formed from a material (brass) that is relatively expensive and time-consuming to manufacture.

Thus, applicants believe that there is a demand for an improved valve element for thermostatic expansion valves which overcomes these shortcomings, and in particular for a valve element that is provided as an integral assembly where the different components of the valves element cannot become easily disassembled when removed from the valve, and which is formed from components that are relatively inexpensive to manufacture.

SUMMARY OF THE PRESENT INVENTION

The present invention provides a novel and unique thermostatic expansion valve, particularly for vehicle air-conditioning systems, that has a valve element which is provided as an integral assembly where the components of the assembly cannot become easily disassembled when removed from the valve, and which is formed from components that are relatively inexpensive to manufacture.

According to the present invention, the valve assembly comprises an assembly of two injection molded parts and a spring, where the injection molded parts are moveably connected together such that they cannot be easily disassembled. The spring is located between the injection molded parts, and also cannot be easily disassembled from the two parts. The two parts are easy to manufacture, relatively inexpensive, and cannot fall apart and become lost when the valve element is removed from the valve body.

The injection molded parts comprise a plunger and a plunger retainer. The plunger includes a cylindrical body and a cylindrical stem extending downwardly from the plunger body and terminating in an annular catch. A shoulder extends radially outward from the periphery of the lounger body and forms an upper spring stop. A throttling element for the valve orifice is provided in the upper end of the plunger body. Preferably the throttling element comprises a component (such as a hemispherical or cone-shaped component) formed unitarily (in one piece) with the upper end of the plunger, although the throttling element could also be a separate component, such as a ball, supported by the upper surface of the plunger, such as in a hemispherical cup formed in the upper surface. In any case, the remainder of the plunger is preferably formed unitarily (in one piece) from conventional molded material, such as plastic or other appropriate material.

The plunger retainer for the valve assembly includes a base with external threads, which is designed to be screwed into the passage in the body leading to the condenser port. The base has a central through-passage, which allows refrigerant to flow through the base from the condenser to the evaporator. A pair of fingers extend upwardly from the base and include a pair of inwardly-projecting catch devices at their distal ends. The portion of the upper surface of the base surrounding the fingers defines a lower spring stop. The plunger retainer is also preferably formed unitarily (in one piece) from conventional molded material, such as plastic, or other appropriate material.

The spring is received around the plunger and the plunger retainer and extends between the upper and lower springs stops. The spring is dimensioned to urge the plunger and plunger retainer axially away from one another.

The stem of the plunger is dimensioned to be received between the fingers of the plunger retainer, with the spring extending between the upper spring stop on the plunger and the lower spring stop on the retainer. The catch on the fingers are dimensioned to engage the annular catch at the lower end of the stem to prevent the plunger, plunger retainer and spring from being disassembled. When the valve assembly is mounted in the valve body, the plunger can move axially with respect to the plunger retainer (against the spring) to control the flow of refrigerant through the valve. The plunger retainer can be screwed into and out of the passage in the valve body to adjust the spring force on the throttling member, and hence adjust the flow through the valve body, As described above, a novel and unique thermostatic expansion valve, particularly for vehicle air-conditioning systems, is provided by the present invention, where the valve has a valve element as an integral assembly where the different components of the assembly cannot become easily disassembled when removed from the valve, and where the valve assembly is formed from components that are relatively inexpensive to manufacture.

The present invention thereby provides a novel and unique thermostatic expansion valve that is believed overcomes many of the drawbacks of the prior devices.

Further features of the present invention will become apparent to those skilled in the art upon reviewing the following specification and attached drawings.

DETAILED DESCRIPTION OF THE PREFERRED EMBODIMENT

Figure 1:
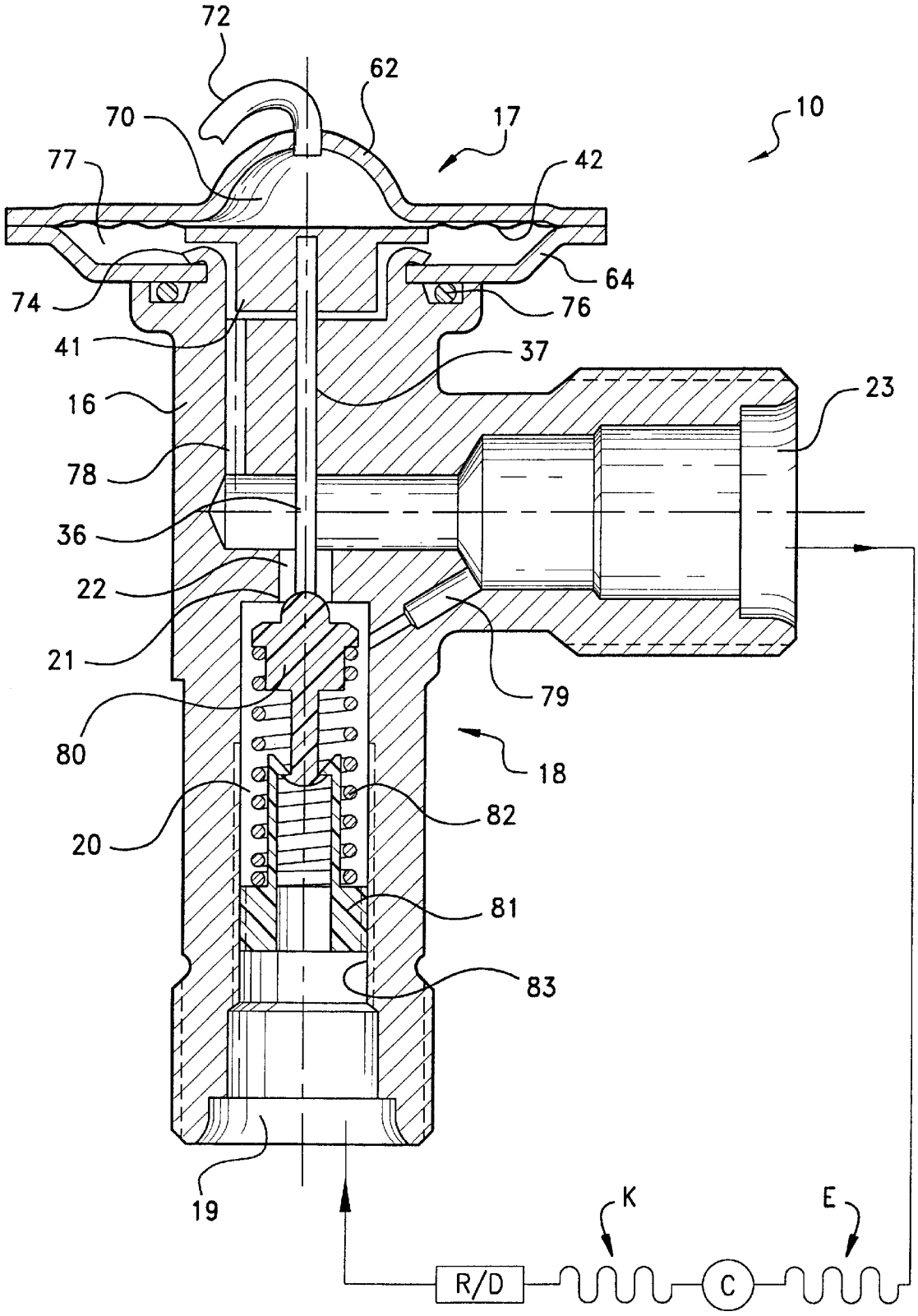
FIG. 1 is a cross-sectional side view of a thermostatic expansion valve constructed according to the principles of the present invention.

Referring to the drawings, and initially to FIG. 1, a thermostatic expansion valve constructed according to the principles of the present invention is indicated generally at 10. The expansion valve is particularly useful for vehicle air conditioning systems although it should be appreciated that the expansion valve could also be used in non-vehicle applications (such as in industrial air conditioning systems). The expansion valve includes a body 16 having a control sensing section, indicated generally at 17, and a metering section, indicated generally at 18. The body 16 of the expansion valve is preferably formed from an appropriate material such as metal (e.g., aluminum alloy).

Refrigerant in an air-conditioning system flows through a condenser "K" and receiver/dryer "R/D" into inlet passage 19 (condenser outlet port) of the valve 10. A valve assembly, indicated generally at 20, is disposed in the metering section 18 and controls the flow through an orifice 21 defined at the lower end of a metering passage 22 fluidly connecting inlet passage 19 to an outlet passage 23 (evaporator inlet port). Refrigerant leaving the outlet passage then flows to an evaporator "E" and then to a compressor "C" to begin the cycle anew. Such a valve could also operate in reverse, i.e., with passage 19 connected to the evaporated inlet, and passage 23 connected to the condenser outlet. This should be well-known to those skilled in the art. In any case, port 19 and port 23 include external threads to allow the expansion valve to be fluidly connected to appropriate tubes or pipes within the refrigeration system.

The valve assembly 20 is actuated by a valve stem 36 extending axially through an internal bore 37 in the valve body and through metering passage 22. The upper end of stem 36 is connected to a pressure pad 41, which is connected to the underside of diaphragm 42. The diaphragm 42 is mounted between an annular domed head or upper housing portion 62, and an annular support cup or lower housing portion 64, which together define a power element for the expansion valve. Diaphragm 42 is sealed around its periphery to domed head 62 and support cup 64, such as by welding or brazing. A head chamber 70 is defined between domed head 62 and one (upper) surface of diaphragm 42. Head chamber 70 is charged with a temperature-responsive charge through capillary tube 72, which is then sealed off as commonly known in bulbless-types of expansion valves. Alternatively, capillary tube 72 can extend to a feeler bulb, in contact with one of the pipes or tubes in the refrigeration system, such as the tube leading to the condenser. As should be known, this allows the charge in the diaphragm chamber to be maintained at approximately the same temperature as the refrigerant in the system at the location of the feeler bulb.

On the other side of the diaphragm, support cup 64 is fixed to valve body 16 such as by bending a collar 74 of the valve body outwardly around the annular mouth of the cup. An O-ring seal 76 can be provided between the body 16 and the cup 64 to ensure a fluid-type seal. The other (lower) surface of diaphragm 42 and support cup 64 define a diaphragm chamber 77. Diaphragm chamber 77 is in fluid communication with inlet passage 19 through an axial passage 78. A portion of the refrigerant entering passage 19 from the condenser outlet and passing through the valve assembly 20 flows through axial passage 78 and into lower diaphragm chamber 77. If necessary or desirable, a bypass passage 79 can be formed from inlet passage 19 to outlet passage 23, to provide a blood hole for the valve.

While one type of power element for the expansion valve is described above, it should be appreciated that this is only exemplary, and other types of power elements where a diaphragm is supported in a chamber, and a valve stem is operatively connected in some manner to the diaphragm, could be used with the present invention.

The valve assembly 20 for the expansion valve includes a plunger 80, a plunger retainer 81, and a compression spring 82 surrounding the plunger 80 and the plunger retainer 81 and biasing these components away from the one another. The valve assembly 20 is located in an upper end of the passage 19, which includes a portion with internal threads 83.

Figure 2:
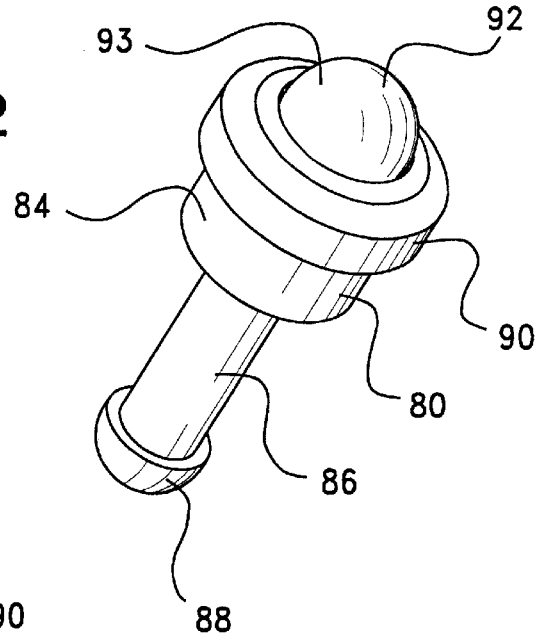
FIG. 2 is an isometric view of the plunger for the valve assembly of the expansion valve of FIG. 1.
Figure 3:
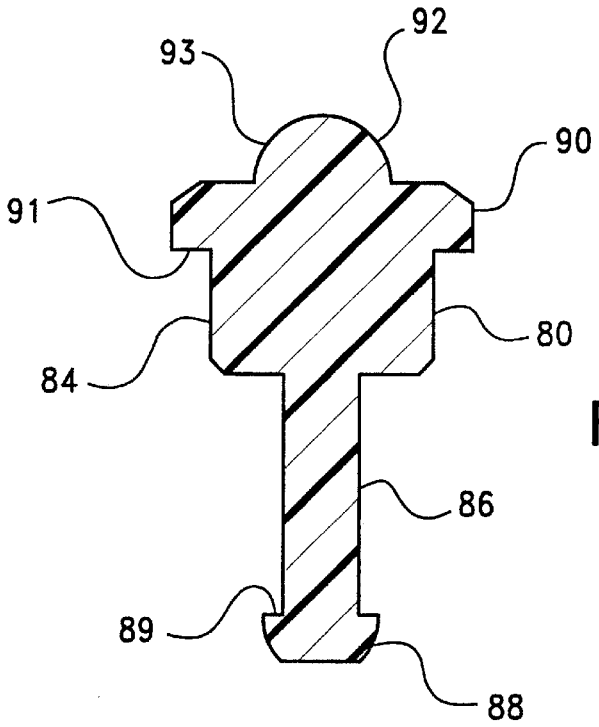
FIG. 3 is a cross-sectional side view of the plunger of FIG. 2.

Referring now to FIGS. 2 and 3, the plunger 80 of the valve assembly includes a cylindrical body 84 and a cylindrical stem 86 extending downwardly from the body. The stem has a distal lower end which terminates in a radially-outward projecting annular catch 88. The catch 88 has a relatively flat and well-defined shoulder 89 facing the upper end of the plunger. A shoulder 90 extends radially outward around the periphery of the cylindrical body 84 and forms an upper annular spring stop 91. A throttling member 92 is provided on the upper end of the cylindrical body 84. Preferably the throttling member 92 comprises a component (such as a hemispherical or cone-shaped component) formed unitarily (in one piece) with the upper end of the plunger. The throttling member 92 controls fluid flow through the valve orifice 21 at the lower end of the metering passage 22. If necessary or desirable, a small bypass passage 93 can be formed through the throttling member 92 and the plunger body 84 to provide a bleed hole for the valve.

Figure 4:
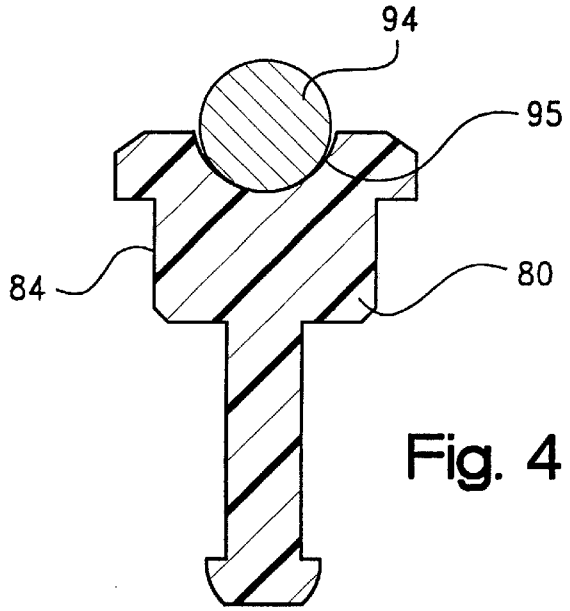
FIG. 4 is a cross-sectional side view of the plunger, illustrating a different form of the plunger.

Alternatively, as shown in FIG. 4, the throttling member could also be a separate component, such as a ball 94, supported by the upper surface of the plunger 80, such as in a hemispherical cup 95. In this case, the throttling member could be constructed of any material (e.g., stainless steel) appropriate for the particular application. Other configurations besides a ball, such as a conical member, are also possible. In any case, the remainder of the plunger 80 is preferably formed unitarily (i one piece) from conventional molded material, such as plastic or other appropriate inexpensive material.

While the catch device of the stem is described above and illustrated as having a continuous annular configuration, it is also possible that the catch could have order configurations, such as one or more radially-outward extending tabs, radially-inward extending annular catches or discrete tabs, or still other configurations that would serve the purpose of a catch device on the end of the stem, or even more broadly, serve the purpose of a catch device on the plunger. It is preferred that the catch device be formed unitarily (in one piece) with the stem, however it is also possible that the catch device could be formed as a separate component and later affixed to the stem.

Figure 5:
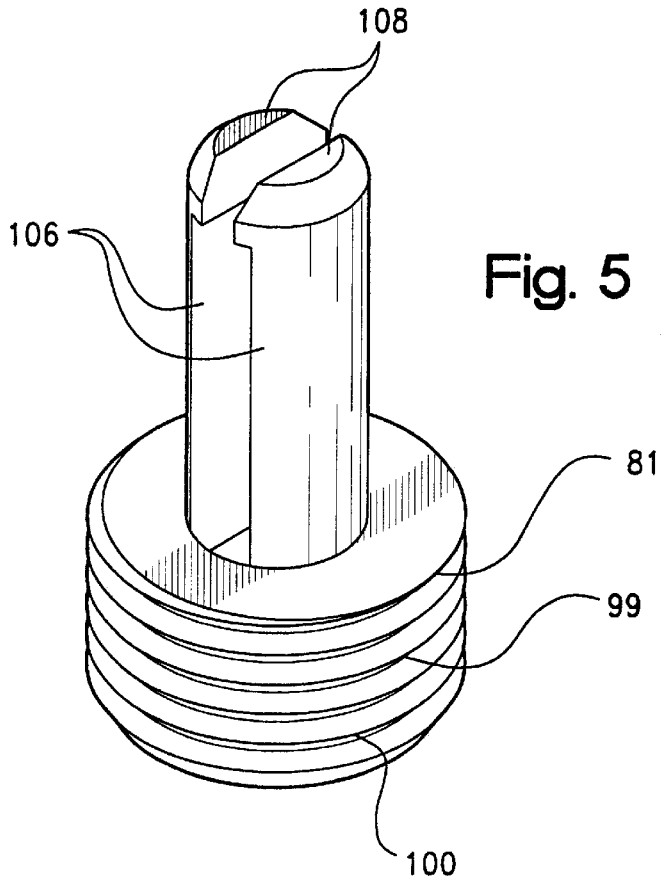
FIG. 5 is an isometric view of the plunger body for the valve assembly of the expansion valve of FIG. 1.
Figure 6:
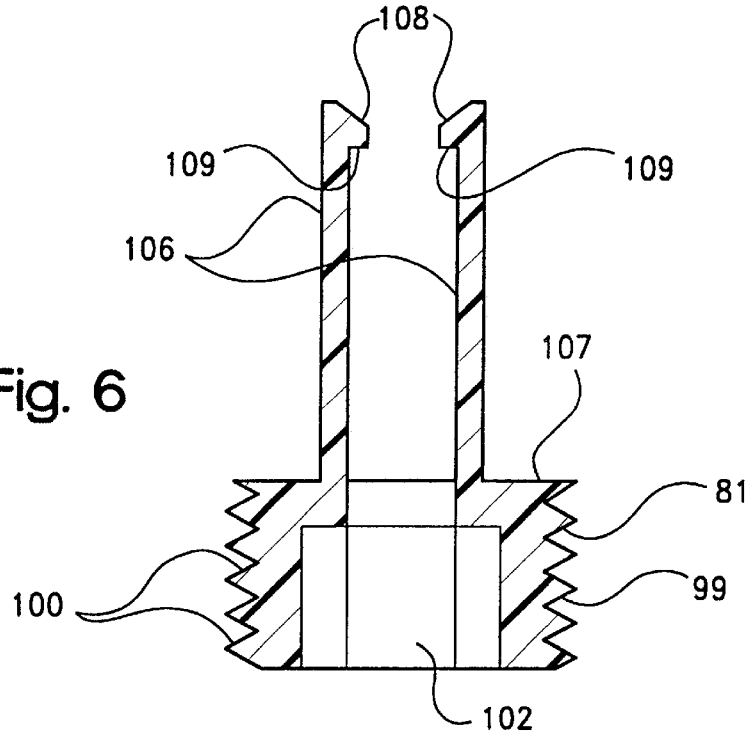
FIG. 6 is a cross-sectional side view of the plunger body of FIG. 5.

Referring now to FIGS. 5 and 6, the plunger retainer 81 for the valve assembly includes a base 99 with external threads such as at 100. The base 99 is designed to be screwed into the inlet passage 19 in the valve body 16, with the threads 100 of the plunger retainer cooperating with the threads 83 (FIG. 1) in the passage. The base 99 of the plunger retainer has a central through-passage 102, which allows refrigerant to flow through the base in the valve body. A pair of spaced-apart resiliently-deflectable fingers 106 extend upwardly from the upper surface of the base, outwardly bounding the through hole 102. The portion of the upper surface of the base surrounding the fingers defines in annular lower spring stop 107.

While a pair of fingers are described above and illustrated, it is possible that only a single finger, or three or more fingers (for example in an annular arrangement), could be used with the present invention. It is also possible that a cylindrical collar with "spring fibers" or an otherwise resilient portion at the distal end of the collar, could be used with the present invention. It is preferred that the finger(s) be formed unitarily (in one piece) with the base, however it is also possible that the fingers could be formed as a separate components and later affixed to the base.

In any case, a catch device 108 is provided at the distal end of each finger, with the catch devices 108 of all the fingers projecting inwardly toward each other. The catch devices are illustrated as short, radially-inward projecting tabs, each of which have a flat and well-defined shoulder 109 facing the lower end of the plunger retainer. It is possible that the catch devices could have other configurations than as described above, and that the fingers could likewise have other configurations that would serve the purpose of the catch devices on the end of the fingers, or even more broadly, that would serve the purpose of a catch device on the plunger retainer. It is preferred that the catch device(s) be formed unitarily (in one piece) with the fingers (or base), however it is also possible that the catch device(s) could be formed as a separate components and later affixed to the fingers/base. In any case, the remainder of the plunger retainer 81 is also preferably formed unitarily (in one piece) from conventional molded material, such as plastic, or other appropriate inexpensive material.

The stem 86 of the plunger 80 is dimensioned to be received between the fingers 106 of the plunger retainer 81, with the catch devices 108 on the fingers dimensioned to engage the annular catch 88 at the lower end of the stem when these components are moved axially away from each other. Shoulders 109 of fingers 108 cooperate with shoulder 89 on stem 86 to prevent these components from being easily disassembled. The retention of the plunger on the plunger retainer also retains the spring on these components during assembly, or inspection and repair of the valve. On the other hand, the fingers 106 easy deflect to allow the stem 86 of the plunger to be inserted between the fingers during assembly. The fingers can each have tapered distal ends and the stem likewise can have a tapered distal end to facilitate the insertion of the stem between the fingers. If desirable, the fingers can also be intentionally flexed apart to separate the plunger from the plunger retainer (such as if one of the components needs to be replaced), however, the plunger is not otherwise easily removeable from the plunger retainer.

While the annular catch 88 at the distal end of the stem 86 preferably is closely received between the fingers 106, the stem can easily slide axially (and of course rotate) between these components, preferably without deflecting the fingers. If desirable, the annular catch 88 and fingers 106 can be dimensioned to cause a predetermined amount of friction therebetween, so as to damp the movement of the throttling member in the valve body. Again, while it is described above that the plunger retainer has a resilient catch device (the fingers) that receive a non-resilient catch device (the stem) on the plunger, it should be appreciated that this could be reversed, that is, the plunger could have a resilient catch device that receives a non-resilient catch device on the plunger retainer, or that both the plunger and plunger retainer could have cooperating resilient catch devices to allow the plunger and plunger retainer to be easily assembled, but to prevent them from being easily disassembled.

As can be seen in FIG. 1, the spring 82 is received around the plunger 80 and the plunger retainer 81 and extends between the upper spring stop 91 on the plunger (FIG. 3) and the oppositely-facing lower spring stop 107 on the plunger retainer (FIG. 6). The spring 82 is dimensioned to urge the plunger and plunger retainer axially away from one another. As indicated above, the annular catch 88 on the plunger stem 86 engages the catch devices 108 on the fingers 106 to retain (lock) the components together as an integral assembly. When the valve assembly 20 is mounted in the valve body 16, the plunger can easily move axially with respect to the plunger retainer (against the spring) to control the flow of refrigerant through the valve. Refrigerant pressure against the diaphragm along with the force of the spring 82 tends to close the valve (i.e., move the throttling member 92 toward the orifice 21 at the lower end of metering passage 22), while pressure from the charge in the head chamber tends to open the valve (i.e., move the throttling member away from the orifice 22). The balance of forces across the diaphragm along with the spring constant of the diaphragm determine the deflection of the diaphragm and hence the opening of the expansion valve orifice between the condenser and evaporator. The diaphragm deflects as appropriate to maintain a balance between these forces. The plunger retainer 81 can be screwed into and out of the passage 23 in the valve body to adjust the spring force on the throttling member on the plunger, and hence adjust the flow through the valve body.

When the valve assembly is removed for inspection and repair, the components (plunger, plunger retainer and spring) are held together so as to not become lost. Since the plunger and plunger retainer are each formed in one piece from an inexpensive molded material, this also reduces the cost associated with the valve assembly.

As such, a novel and unique thermostatic expansion valve, particularly for vehicle air-conditioning systems, is provided by the present invention, where the valve has a valve element as an integral assembly where the different components of the assembly cannot become easily disassembled when removed from the valve, and where the valve assembly is formed from components that are relatively inexpensive to manufacture.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A thermostatic expansion valve, comprising:

a body having a metering passage fluidly connecting a first passage in the body and second passage in the body, and defining a flow path through the body;

a power element integral with said body, said power element including a diaphragm supported within a diaphragm chamber;

a valve assembly in the first passage, said valve assembly including i) a plunger retainer threadably received in the first passage, ii) a plunger moveably connected to the plunger retainer and having a throttling member controlling the flow through an orifice in the metering passage, and iii) a spring extending between the plunger and biasing the plunger, and hence the throttling member, toward the orifice, the plunger and plunger retainer including cooperating catch devices to allow the plunger to be easily assembled with the plunger retainer, and to prevent the plunger from being easily disassembled from the plunger retainer; and a valve stem operatively connected to and extending away from the diaphragm through an internal bore in the valve body into said metering passage and engaging said valve assembly, wherein the movement of the diaphragm in the diaphragm chamber controls the movement of the throttling member of the valve assembly and hence controls the flow through the expanding valve.

2. The thermostatic expansion valve as in claim 1, wherein one of the catch devices is resilient deflectable to allow the plunger to be assembled with the plunger retainer.

3. The thermostatic expansion valve as in claim 2, wherein the plunger retainer includes a base with external threads, and a pair of spaced apart fingers are integral with the base and extend outwardly away therefrom toward the plunger, the fingers each including a catch device at the distal end of the respective finger, and the catch devices of the finger projecting inwardly toward each other and dimensioned to cooperate with the catch device of the plunger.

4. The thermostatic expansion valve as in claim 3, wherein the fingers are unitary with the base.

5. The thermostatic expansion valve as in claim 4, wherein the base includes a through-passage allowing fluid flow through the base.

6. The thermostatic expansion valve as in claim 5, wherein the fingers outwardly bound the through-passage in the base.

7. The thermostatic expansion valve as in claim 1, wherein the plunger retainer includes an annular lower spring stop facing the plunger, and the plunger includes an annular upper spring stop facing the plunger retainer, and the spring extends between the respective spring stops on the plunger and plunger retainer.

8. The thermostatic expansion valve as in claim 1, wherein said plunger includes a body and a stem extending outwardly from the body toward the plunger retainer, said plunger stem including an annular catch device at the distal end of the plunger stem, the annular catch device dimensioned to cooperate with the catch device of the plunger.

9. The thermostatic expansion valves as in claim 8, wherein said throttling member is unitary with said plunger.

10. The thermostatic expansion valve as in claim 1, wherein the plunger retainer includes a base with external threads and a through-passage in the base allowing fluid flow through the base, and a pair of spaced apart fingers are unitary with the base and outwardly bound the through passage, the fingers extending outwardly away from the base toward the plunger and the fingers each include a catch device at the distal end of the respective finger, the catch devices of the fingers projecting inwardly toward each other, and said plunger including a body and a stem extending outwardly from the body toward the plunger retainer, said plunger stem including an annular catch device at the distal end of the plunger stem, the catch devices of the fingers dimensioned to cooperate with the annular catch device of the stem.

11. A thermostatic expansion valve, comprising:

a body having a metering passage fluidly connecting a condenser outlet passage and an evaporator inlet passage and defining a flow path through the body;

a power element integral with said body, said power element including a diaphragm supported within a diaphragm chamber;

a valve assembly in the condenser outlet passage, said valve assembly metering fluid flow through an orifice in the metering passage, said valve assembly consisting only of a plunger retainer, a plunger and a spring, said plunger retainer threadably received in the condenser outlet passage, said plunger moveably connected to the plunger retainer and having a throttling member controlling the flow through the orifice in the metering passage and said spring extending between the plunger retainer and the plunger and biasing the plunger, and hence the throttling member, toward the orifice; and a valve stem operatively connected to and extending away from the diaphragm through an internal bore in the valve body into said metering passage and engaging said valve assembly, wherein the movement of the diaphragm in the diaphragm chamber controls the movement of the throttling member of the valve assembly and hence controls the flow through the expansion valve.

12. The thermostatic expansion valve as in claim 11, the plunger and plunger retainer including cooperating catch devices wherein one of the catch devices is resiliently deflectable to allow the plunger to be assembled with the plunger retainer.

13. The thermostatic expansion valve as in claim 12, wherein the plunger retainer includes a base with external threads, and a pair of spaced apart fingers are integral with the base and extend outwardly away therefrom toward the plunger, the fingers each including a catch device at the distal end of the respective finger, and the catch devices of the fingers projecting inwardly toward each other and dimensioned to cooperate with the plunger to prevent the plunger from being disassembled from the plunger retainer.

14. The thermostatic expansion valve as in claim 11, wherein the fingers are unitary with the base.

15. The thermostatic expansion valve as in claim 14, wherein the base includes a through-passage allowing fluid flow through the base.

16. The thermostatic expansion valve as in claim 15, wherein the fingers outwardly bound the through-passage in the base.

17. The thermostatic expansion valve as in claim 11, wherein the plunger retainer includes an annular lower spring stop facing the plunger, and the plunger includes an annular upper spring stop facing the plunger retainer, and the spring extends between the respective spring stops on the plunger and plunger retainer.

18. The thermostatic expansion valve as in claim 11, wherein said plunger includes a body and a stem extending outwardly from the body toward the plunger retainer, said plunger stem including an annular catch device at the distal end of the plunger stem, the annular catch device dimensioned to cooperate with the plunger retainer to prevent the plunger from being disassembled from the plunger retainer.

19. The thermostatic expansion valve as in claim 18, wherein said throttling member is unitary with said plunger.

20. The thermostatic expansion valve as in claim 11, wherein the plunger retainer includes a base with external threads and a through-passage in the base allowing fluid flow through the base, and a pair of spaced apart fingers are unitary with the base and outwardly bound the through passage, the fingers extending outwardly away from the base toward the plunger and the fingers each include a catch device at the distal end of the respective finger, the catch devices of the fingers projecting inwardly toward each other, and said plunger including a body and a stem extending outwardly from the body toward the plunger retainer, said plunger stem including an annular catch device at the distal end of the plunger stem, the catch devices of the fingers dimensioned to cooperate with the annular catch device of the stem.

21. A thermostatic expansion valve, comprising:

a body having a metering passage fluidly connecting a condenser outlet passage and an evaporator inlet passage and defining a flow path through the body;

a power element integral with said body, said power element including a diaphragm supported within a diaphragm chamber;

a valve assembly in the condenser outlet passage, said valve assembly including i) a plunger retainer threadably received in the condenser outlet passage, ii) a plunger moveably connected to the plunger retainer and having a throttling member controlling the flow through an orifice in the metering passage, and iii) a sprig extending between the plunger retainer and the plunger and biasing the plunger, and hence the throttling member, toward the orifice, said plunger including a stem extending away from the plunger and toward the plunger retainer, said plunger stem including an annular catch device which engages a portion of the plunger retainer to prevent the plunger from being disassembled from the plunger retainer; and a valve stem operatively connected to and extending away from the diaphragm through an internal bore in the valve body into said metering passage and engaging said valve assembly, wherein the movement of the diaphragm in the diaphragm chamber controls the movement of the throttling member of the valve assembly and hence controls the flow through the expansion valve.

22. The thermostatic expansion valve as in claim 21, wherein the plunger retainer includes a resilient portion which cooperates with the annular catch on the valve stem to allow the plunger retainer to be easily assembled with the plunger.

23. The thermostatic expansion valve as in claim 22, wherein the plunger retainer includes a base with external threads, and a pair of spaced apart finger are integral with the base and extend outwardly away therefrom toward the plunger, the fingers each including a catch device at the distal end of the respective finger, and the catch devices of the fingers projecting inwardly toward each other and dimensioned to cooperate with the catch device of the plunger.

24. The thermostatic expansion valve as in claim 23, wherein the fingers are unitary with the base.

25. The thermostatic expansion valve as in claim 24, wherein the base includes a through passage allowing fluid flow through the base.

26. The thermostatic expansion valve as in claim 25, wherein the fingers outwardly bound the through-passage in the base.

27. The thermostatic expansion valve as in claim 21, wherein the plunger retainer includes an annular lower spring stop facing the plunger, and the plunger includes an annular upper spring stop facing the plunger retainer, and the spring extends between the respective spring stops on the plunger and plunger retainer.

28. The thermostatic expansion valve as in claim 21, wherein said throttling member is unitary with said plunger.

29. A thermostatic expansion valve, comprising:

a body having a metering passage fluidly connecting a condenser outlet passage and an evaporator inlet passage and defining a flow path through the body;

a power element integral with said body, said power element including a diaphragm supported within a diaphragm chamber;

a valve assembly in the condenser outlet passage, said valve assembly including i) a plunger retainer threadly received in the condenser outlet passage, ii) a plunger moveably connected to the plunger retainer and having a throttling member controlling the flow through an orifice in the metering passage, and iii) a spring extending between the plunger retainer and the plunger and biasing the plunger, and hence the throttling member, toward the orifice, said plunger retainer including a base with external threads and at least one finger unitary with the base and extending away from the base and toward the plunger, said at least one finger including a catch device which engages a portion of the plunger to prevent the plunger from being disassembled from the plunger retainer; and a valve stem operatively connected to and extending away from the diaphragm through an internal bore in the valve body into said metering passage and engaging said valve assembly, wherein the movement of the diaphragm in the diaphragm chamber controls the movement of the throttling member of the valve assembly and hence controls the flow through the expansion valve.

30. The thermostatic expansion valve as in claim 29, wherein at least one finger is resiliently deflectable to allow the plunger retainer to be easily assembled with the plunger.

31. The thermostatic expansion valve as in claim 30, wherein the at least one finger is unitary with the base.

32. The thermostatic expansion valve as in claim 31, wherein the base includes a through-passage allowing fluid flow through the base.

33. The thermostatic expansion valve as in claim 32, wherein the at least one finger outwardly bounds the through-passage in the base.

34. The thermostatic expansion valve as in claim 30, wherein the plunger retainer includes an annular lower spring stop facing the plunger, and the plunger includes an annular upper spring stop facing the plunger retainer, and the spring extends between the respective spring stops on the plunger and plunger retainer.

35. The thermostatic expansion valve as in claim 30, wherein said plunger includes a body and a stem extending outwardly from the body toward the plunger retainer, said plunger stem including an annular catch device at the distal end of the plunger stem, the annular catch device dimensioned to cooperate with plunger to prevent the plunger from being disassembled from the plunger retainer.

36. The thermostatic expansion valve as in claim 35, wherein said throttling member is unitary with said plunger.

37. A thermostatic expansion valve, comprising:

a body having a metering passage fluidly connecting a condenser outlet passage and an evaporator inlet passage and defining a flow path through the body;

a power element integral with said body, said power element including a diaphragm supported within a diaphragm chamber;

a valve assembly in the condenser outlet passage, said valve assembly including i) a plunger retainer threadably received in the condenser outlet passage, ii) a plunger moveably connected to the plunger retainer and having a throttling member controlling the flow through an orifice in the metering passage, and iii) a spring extending between the plunger retainer and the plunger and biasing the plunger, and hence the throttling member toward the orifice, and further including means integral with said plunger and said plunger retainer for allowing easy assembly of the plunger with the plunger retainer and preventing easy disassembly of the plunger from the plunger retainer; and a valve stem operatively connected to and extending away from the diaphragm through an internal bore in the valve body into said metering passage and engaging said valve assembly, wherein the movement of the diaphragm in the diaphragm chamber controls the movement of the throttling member of the valve assembly and hence controls the flow through the expansion valve.

38. The thermostatic expansion valve as in claim 37, wherein said means includes resilient means.

39. The thermostatic expansion valve as in claim 38, wherein said plunger and said plunger retainer are each unitary, one-piece components.

* * * * *